US005115930A

United States Patent [19]

Lohrman et al.

[11] Patent Number: 5,115,930

[45] Date of Patent: May 26, 1992

[54] TWO-PIECE CLOSURE

[76] Inventors: Richard D. Lohrman, 154 Mainsail Dr., Grayslake, Ill. 60030; Philip Ferber, 2239 N. Bissell #2N, Chicago, Ill. 60614; Gene Dorsch, 18 W. Garden, Palatine, Ill. 60067

[21] Appl. No.: 701,209

[22] Filed: May 16, 1991

[51] Int. Cl.[5] ..... B65D 55/00

[52] U.S. Cl. ..... 215/227; 215/228; 215/230; 215/235; 215/253

[58] Field of Search ..... 215/227, 228, 230, 235, 215/237, 250, 253; 220/212, 377, 506, 521, 528

[56] References Cited

U.S. PATENT DOCUMENTS

| | | | |
|---|---|---|---|
| 1,031,867 | 7/1912 | Peebles . | |
| 1,480,415 | 1/1924 | Pierce | 215/227 |
| 2,046,745 | 7/1936 | Hoag | 40/20 |
| 2,168,594 | 8/1939 | Von Till . | |
| 3,002,647 | 10/1961 | Potoff et al. . | |
| 3,050,212 | 8/1962 | Longo . | |
| 3,085,709 | 4/1963 | Klein . | |
| 3,346,135 | 10/1967 | Haitsch | 215/227 |
| 3,628,686 | 12/1971 | Burton et al. . | |
| 3,768,688 | 10/1973 | Linke | 215/227 X |
| 3,896,974 | 7/1975 | McIntosh | 222/182 |
| 4,165,009 | 8/1979 | Murayama | 215/230 |
| 4,253,580 | 3/1981 | Doi et al. | 215/228 |
| 4,632,264 | 12/1986 | Evans | 215/220 |
| 4,699,188 | 10/1987 | Baker et al. | 141/18 |
| 4,723,669 | 2/1988 | Barriac | 215/206 |
| 4,723,671 | 2/1988 | Mears | 215/228 |
| 4,753,358 | 6/1988 | Virca et al. | 215/230 |
| 4,771,902 | 9/1988 | Teng | 215/1 R |
| 4,778,071 | 10/1988 | Fillmore | 215/237 |
| 4,795,044 | 1/1989 | Beck | 215/237 |
| 5,025,941 | 6/1991 | Petit | 215/228 |

FOREIGN PATENT DOCUMENTS

| | | |
|---|---|---|
| 0285466 | 4/1987 | European Pat. Off. . |
| 2551245 | 5/1977 | Fed. Rep. of Germany . |
| 719330 | 2/1932 | France . |
| 729291 | 5/1955 | United Kingdom . |

*Primary Examiner*—Stephen P. Garbe
*Assistant Examiner*—Nove Sucker
*Attorney, Agent, or Firm*—Kane, Dalsimer, Sullivan, Kurucz, Levy, Eisele and Richard

[57] ABSTRACT

A closure cap with a stock base cap including a hinged cap is provided for cosmetics, toiletries and similar products. The hinged cap includes an annular wall with a partition perpendicular thereto thereby forming an upwardly facing recess to receive ornamental inserts of different colors, textures and shapes.

16 Claims, 3 Drawing Sheets

TWO-PIECE CLOSURE

BACKGROUND OF THE INVENTION

1. Field of the Invention

This invention relates to a cap or closure design for cosmetic, toiletry and similar bottles. The closure design includes a base cap and an interchangeable ornamental insert which engages the base cap. Optionally, the ornamental insert may include a proof-of-purchase disk held in place by bridge-type connectors.

2. Description of the Prior Art

Caps and closure designs for the cosmetic, toiletry and similar bottles are well known in the prior art. In this industry, it is very important to establish a distinctive packaging appearance with high customer recognition. The characteristics of the distinctive packaging appearance will vary with the desired customer base, but will typically aspire to an easily recognized luxurious appearance. However, establishing such an appearance with variations within a product line can be very expensive for the large manufacturer and possibly prohibitive for the small manufacturer.

OBJECTS AND SUMMARY OF THE INVENTION

It is therefore an object of this invention to provide a closure for cosmetics, toiletries and similar products which can be easily changed in appearance to identify a product line to a customer.

It is therefore a further object of this invention to provide a closure for cosmetic, toiletries and similar products which can be changed slightly in appearance to identify variations within a product line to a customer.

It is therefore a still further object of this invention to provide a closure with a proof-of-purchase means.

It is therefore a final object of this invention to provide a closure for cosmetic, toiletries and similar products which can achieve the above objects while being manufactured with simple equipment and low inventories of manufacturing stock.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
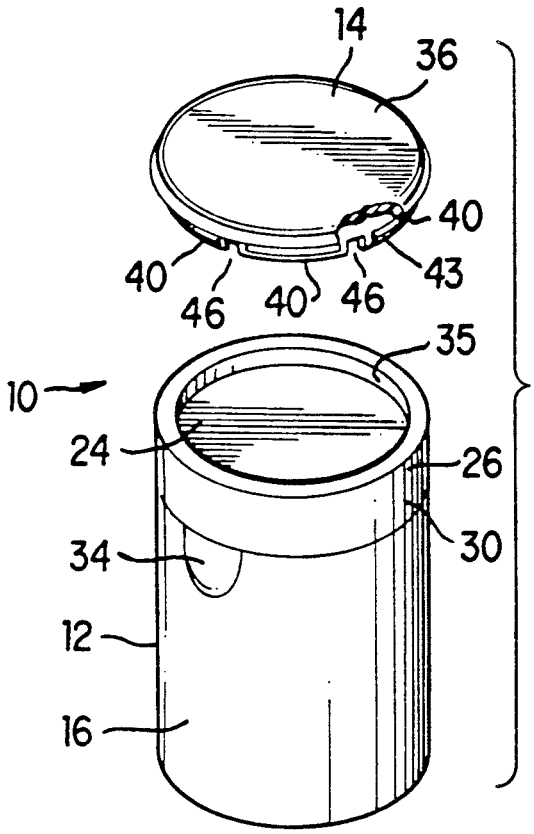
FIG. 1 is a perspective view of the two-piece closure, partly in cross section, including the base cap and the ornamental insert.
Figure 2:
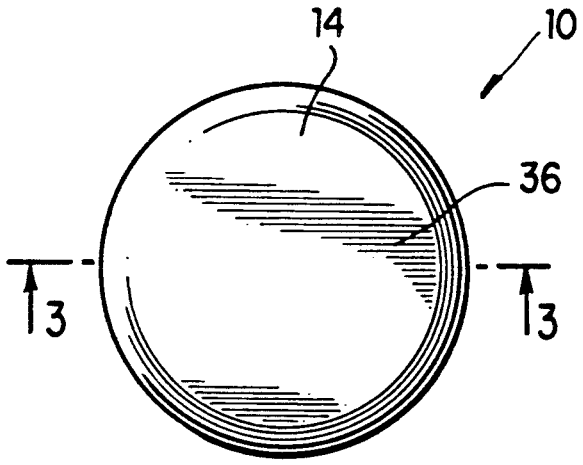
FIG. 2 is a top plan view of the two-piece closure.

Referring now to the drawings in detail wherein like numerals indicate like elements throughout the several views, FIG. 1 discloses closure 10 with a base cap 12 and an ornamental insert 14. Base cap 12 includes cylindrical wall 16 to engage the neck and mouth of a bottle (not shown). As shown in further detail in FIG. 3, base cap 12 includes plate 18 on the mouth of cylindrical wall 16. Plate 18 includes dispensing aperture 20 which is engaged by plug 22 which is integral with horizontal partition 24 of captive cap 26. Captive cap 26 is hingeably attached by snap hinge 28 (such as disclosed in U.S. Pat. No. 4,403,712 to Weisinger) to cylindrical wall 16 allowing cap 26 to swing between an open position wherein plug 22 is removed from dispensing aperture 20 thereby allowing the contents of the bottle (not shown) to be dispensed therefrom and a closed position (illustrated in FIG. 3) wherein aperture 20 is sealed by a frictional fit with plug 22 so that cap 26 is held in place and no contents may be dispensed from the bottle (not shown).

Figure 3:
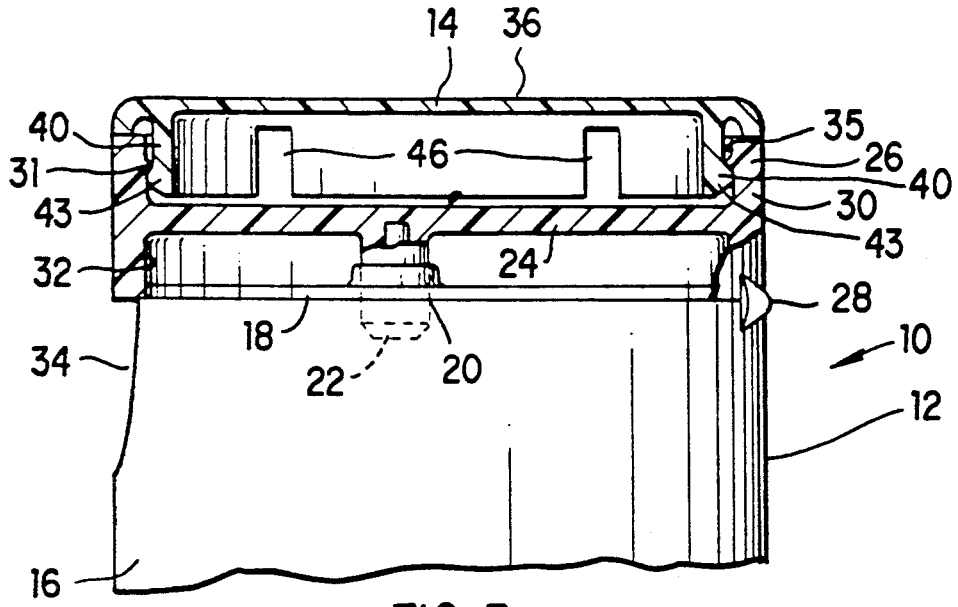
FIG. 3 is a cross-sectional view of the two-piece closure along plane 3—3 of FIG. 2.

Captive cap 26 is formed from annular wall 30 which supports partition 24 at an approximate midpoint therein. Projection bead 31 is formed on the inward periphery of annular wall 30. Downwardly extending recess 32 is formed below partition 24 and faces plate 18 when cap 26 is in a closed position such as illustrated in FIG. 3. Cylindrical wall 16 includes upwardly extending oblique face 34 so as to expose a chord of the periphery of cap 26 allowing the user to more easily disengage the cap 26 from its closed position. Upwardly extending recess 35 is formed above partition 24 and provides for frictional engagement with ornamental insert 14.

Ornamental insert 14 includes circular upper surface 36 further forming downwardly extending lip 38 about the periphery thereof. Indented from the periphery of ornamental insert 14 are downwardly extending flanges 40 interspersed with spaces 42. Flanges 40 include outwardly extending ribs 43 along a lower peripheral portion thereof. Ribs 43 of flanges 40 frictionally engage the interior of annular wall 30 within upwardly extending recess 35 and hold ornamental insert 14 therewithin. Ribs 43, as shown in FIG. 3 are placed in detent position downwardly adjacent to projection bead 31 of annular wall 30.

Figure 4:
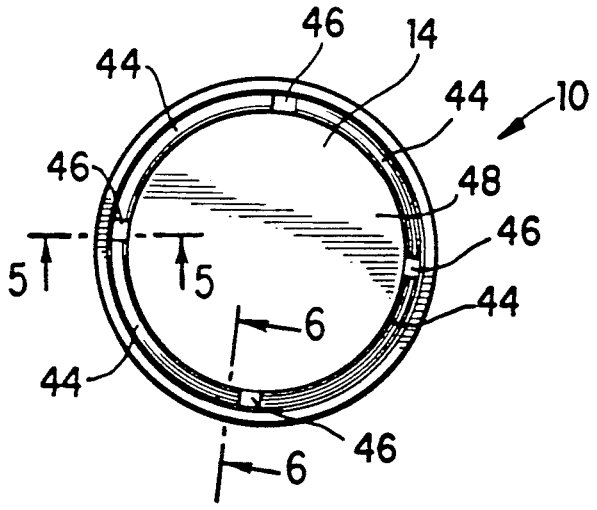
FIG. 4 is a top plan view of the two-piece closure including the proof-of-purchase feature.
Figure 5:
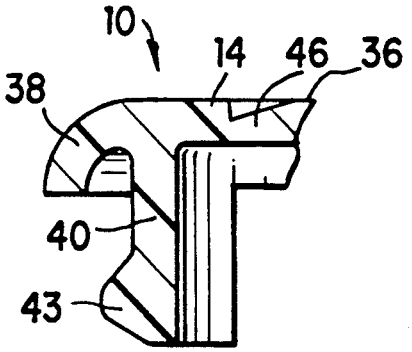
FIG. 5 is a cross-sectional view of the ornamental insert of the two-piece closure along plane 5—5 of FIG. 4.
Figure 6:
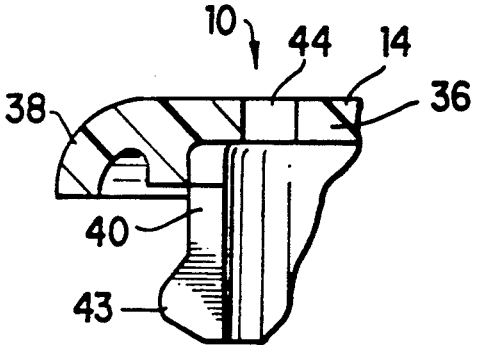
FIG. 6 is a cross-sectional view of the ornamental insert of the two-piece closure along plane 6—6 of FIG. 4.
Figure 7:
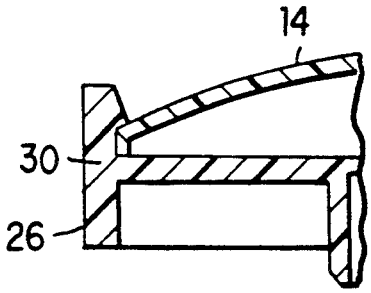
FIGS. 7-10 are cross-sectional views of alternative engagements between the ornamental insert and the two-piece closure.
Figure 8:
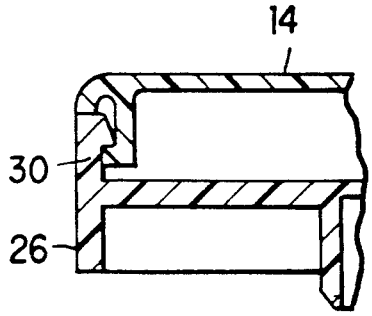
Figure 9:
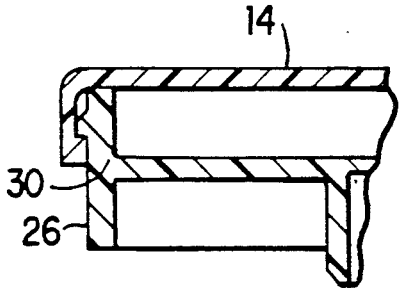
Figure 10:
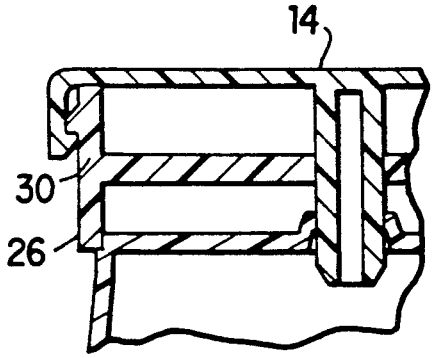

Optionally, as shown in FIGS. 4, 5 and 6, circular upper surface 36 may include slots 44 with bridges 46 therebetween so as to form a removable disk 48. Removable disk 48 is separated from ornamental insert 14 by the user breaking bridges 46. Disk 48 can be used thereafter as a proof-of-purchase.

FIGS. 7-10 are cross-sectional views of alternative engagements between ornamental insert 14 and the closure 10.

Although ornamental insert 14 is illustrated as a flat piece, ornamental insert 14 may be any number of shapes including flat top, domed top, thin stripe, thick stripe or even castle top at minimal additional cost. Additionally, ornamental insert 14 is typically provided in a color and/or texture contrasting from base cap 12. Base cap 12 is typically a stock closure with a stock neck finish to fit standard bottles. Moreover, ornamental insert 14 may include a company logo or trademark for the minimal capital investment cost of a four or eight cavity tool.

Closure 10 eliminates the need to carry large inventories of multiple colored or shaped closures in that a single inventory of white base caps along with an inventory of multiple colored and shaped inserts may be stocked and applied on the filling line with inexpensive capping equipment.

Thus the several aforementioned objects and advantages are most effectively attained. Although a single preferred embodiment of the invention has been disclosed and described in detail herein, it should be understood that this invention is in no sense limited thereby and its scope is to be determined by that of the appended claims.

What is claimed is:

1. A closure cap including:

a base cap with means for engaging a mouth of a container; a dispensing aperture leading from the mouth of the container; means for preventing flow through said aperture, including a planar portion with an upper side and a lower side, and a plug portion on said lower side of said planar portion for engaging said aperture; hinged means for swinging said preventing means away from said aperture so as to allow flow therethrough; and an engaging means on said upper side of said planar portion; and an insert adapted to be engaged by said engaging means for providing aesthetic features different from said base cap.

2. The closure cap of claim 1 wherein said preventing means comprises a captive cap which swings between an open position and a closed position; said captive cap including an annular wall with said planar portion therewithin, wherein said planar portion is perpendicular to said annular wall thereby forming a first recess above said planar portion; and wherein said engaging means comprises said first recess above said planar portion.

3. The closure cap of claim 2 wherein said plug portion comprises a male element downwardly extending from said planar portion of said captive cap; wherein said male element is frictionally engaged by said dispensing aperture when said captive cap is in a closed position.

4. The closure cap of claim 3 wherein said hinged means includes a hinge between said base cap and said captive cap.

5. The closure cap of claim 4 wherein said hinge comprises a snap hinge.

6. The closure cap of claim 3 wherein a second recess is formed in said captive cap below said planar portion, said second recess facing said base cap when said captive cap is in said closed position.

7. The closure cap of claim 3 wherein said insert includes downwardly extending flanges adapted to engage said first recess.

8. The closure cap of claim 7 wherein said downwardly extending flanges include horizontally extending ribs for engaging said first recess.

9. The closure cap of claim 8 wherein said insert includes a downwardly extending peripheral lip forming a relatively smooth transition to said base cap.

10. The closure of claim 7 wherein said insert is provided in a variety of colors.

11. The closure cap of claim 7 wherein said insert is provided in a variety of shapes.

12. The closure cap of claim 3 wherein said insert includes a removable disk adapted as a proof-of-purchase.

13. The closure cap of claim 3 wherein said removable disk is attached to said insert by a plurality of bridges.

14. The closure cap of claim 1 wherein said insert is provided in a variety of colors different from said base cap.

15. The closure cap of claim 1 wherein said insert is provided in a variety of textures different from said base cap.

16. The closure cap of claim 1 wherein said insert is provided in a variety of shapes.

* * * * *